US008398257B1

(12) United States Patent
Paulus

(10) Patent No.: US 8,398,257 B1
(45) Date of Patent: Mar. 19, 2013

(54) TOILET LIGHT

(76) Inventor: Matthew Paulus, Apopka, FL (US)

( * ) Notice: Subject to any disclaimer, the term of this patent is extended or adjusted under 35 U.S.C. 154(b) by 77 days.

(21) Appl. No.: 13/048,569

(22) Filed: Mar. 15, 2011

Related U.S. Application Data

(60) Provisional application No. 61/341,250, filed on Mar. 29, 2010.

(51) Int. Cl.
*F21L 4/00* (2006.01)

(52) U.S. Cl. ..... 362/183; 362/101; 362/155; 362/276; 362/802

(58) Field of Classification Search ..... 362/154, 362/155, 157, 183, 190, 191, 641, 642, 396, 362/276, 802, 100; 4/661
See application file for complete search history.

(56) References Cited

U.S. PATENT DOCUMENTS

| | | | | |
|---|---|---|---|---|
| D263,629 | S | 3/1982 | Collins | |
| 4,413,364 | A | 11/1983 | Bittaker | |
| 4,736,471 | A | 4/1988 | Johnson | |
| 4,860,178 | A | 8/1989 | Picon | |
| 5,003,648 | A * | 4/1991 | Anderson | 4/661 |
| 5,036,443 | A * | 7/1991 | Humble et al. | 362/183 |
| 5,136,476 | A | 8/1992 | Horn | |
| 5,136,676 | A * | 8/1992 | Arnett et al. | 385/119 |
| 5,150,962 | A * | 9/1992 | Rauschenberger | 362/101 |
| 5,263,209 | A | 11/1993 | Pattee | |
| 5,276,595 | A * | 1/1994 | Patrie | 362/101 |
| 5,437,066 | A * | 8/1995 | Mills et al. | 4/661 |
| 5,513,397 | A | 5/1996 | Terry | |
| 5,541,816 | A * | 7/1996 | Miserendino | 362/106 |
| 5,611,089 | A | 3/1997 | Cretors | |
| D382,360 | S | 8/1997 | Bixby | |
| 5,664,867 | A * | 9/1997 | Martin et al. | 362/101 |
| D397,465 | S | 8/1998 | Youri | |
| 5,926,867 | A * | 7/1999 | Buchanan | 4/661 |
| 6,003,160 | A | 12/1999 | Seidle | |
| 6,203,164 | B1 * | 3/2001 | Tufekci et al. | 362/101 |
| 7,036,158 | B2 | 5/2006 | Bradford | |
| D571,031 | S | 6/2008 | Perkins | |
| 2004/0184273 | A1 * | 9/2004 | Reynolds et al. | 362/394 |
| 2005/0108819 | A1 | 5/2005 | Bradford | |
| 2008/0028505 | A1 * | 2/2008 | Penn | 4/231 |

* cited by examiner

*Primary Examiner* — John A Ward
(74) *Attorney, Agent, or Firm* — Brian S. Steinberger; Law Offices of Brian S. Steinberger, P.A.

(57) ABSTRACT

Devices, apparatus, and methods of using a solar powered, battery operated, light sensitive toilet seat LED (light emitting diode) lid light device that removably clamps to an edge of the outside toilet seat lid. A solar panel is visible on outside of toilet seat is used to recharge a battery in the device. The underside of device contains the secured battery, circuit board, mercury switch and photocell. When the lid and device are in upright position the mercury switch closes. The photocell senses absence of light and the LED light illuminates the toilet bowl and surrounding area.

19 Claims, 5 Drawing Sheets

TOILET LIGHT

CROSS REFERENCE TO RELATED APPLICATIONS

This invention claims the benefit of priority to U.S. Provisional Application 61/341,250 filed Mar. 29, 2010.

FIELD OF INVENTION

This invention relates to lights, in particular to clip on solar powered light devices, apparatus and methods for clipping on toilet seat lids for illuminating the toilet bowl and surrounding areas after the seat is raised, and the light shut off when the seat is lowered.

BACKGROUND AND PRIOR ART

Many devices have been proposed over the years to illuminate a toilet during the night or in a dark room. See for example, U.S. Pat. Nos. D263,629 to Collins; 4,413,364 to Bittaker; 4,736,471 to Johnson; 4,860,178 to Picon; 5,003,648 to Anderson; 5,150,962 to Rauschenberger; 5,136,476 to Horn; 5,263,209 to Paltee; 5,513,397 to Terry; 5,664,867 to Martin; D382,360 to Bixby; 5,611,089 to Cretors; D397,465 to Youri; 5,819,330 to Yokel; 6,003,160 to Seidle; 7,036,158 to Bradford; and D571,031 to Perkins. See also for example, U.S. Published Patent Applications: 2004/0184273 to Reynolds and 2005/0108819 to Bradford, II et al. However, there are many problems in the prior art.

For example, some prior art devices require the light to be attached to locations that become unsanitary in short periods of time, such as to the rim edges on the toilet bowl, placed directly on the seat and hinged to back of the toilet.

Many of the devices of the prior art require battery only power sources that cannot be recharged and require a constant change of batteries overtime. Additionally, it usually becomes known the battery needs to be changed when the light is not able to turn on during the an actual night-time or dark operating condition, when the light source is most needed to work.

Some of the prior art further requires motion sensing to activate the light source. Some prior art requires large non-aesthetic light sources that appear obtrusive. Some prior art devices require substantial amounts of component assembly and installation and extra time to install. Some of the devices would be expensive to purchase and/or assemble.

Thus, the need exists for solutions to the above problems with the prior art.

SUMMARY OF THE INVENTION

A primary objective of the present invention is to provide novel clip on solar powered light devices, apparatus and methods for toilet seat lids that are simple to install, self contained, low maintenance, solar powered battery run toilet lights.

A secondary objective of the present invention is to provide novel clip on solar powered light devices, apparatus and methods that clamp onto the toilet seat lids, and that will assist people to keep the toilet lid in the down position when not in use.

A third objective of the present invention is to provide novel clip on solar powered light devices, apparatus and methods for toilets that will benefit toilet training, mess prevention and is least subject to unsanitary contamination.

A fourth objective of the present invention is to provide novel clip on solar powered light devices, apparatus and methods for toilets for helping achieve eye adjustment late at night to use the bathroom then returning with uninterrupted sleep.

A fifth objective of the present invention is to provide novel clip on solar powered light devices, apparatus and methods that is nonobtrusive to provide a light in bathrooms so that small children will find the room less frightening, and which gives children the incentive of using the bathroom with confidence when they can see what they are doing.

A sixth objective of the present invention is to provide novel clip on solar powered light devices, apparatus and methods for toilets that is able to provide the elderly with a toilet light device for seeing in the dark in the evening hours or in the middle of the night.

A seventh objective of the present invention is to provide novel clip on solar powered light devices, apparatus and methods for illuminating toilets, that requires no assembly and installation time.

An eighth objective of the present invention is to provide novel clip on solar powered light devices, apparatus and methods for illuminating toilets that only requires clamping the device on the toilet lid, lowering the lid, and allowing for solar light energy to recharge the battery and begin use.

An ninth objective of the present invention is to provide novel clip on solar powered light devices, apparatus and methods for illuminating toilets that is easily transportable, to be moved from one location to another, such as when a person travels to another location with or without children.

An tenth objective of the present invention is to provide novel clip on solar powered light devices, apparatus and methods for illuminating toilets that is easily usable with different sizes and types of toilets.

An eleventh objective of the present invention is to provide novel clip on solar powered light devices, apparatus and methods for illuminating toilets, that is out of the way from being in contact with germs.

The invention relates to a solar toilet light device which clamps on the top of the toilet lid. When positioned up the lid will illuminate the area surrounding the toilet bowl. The toilet seat lid light, comprised by a clamp, which affixes the device on the long side of a metal, preferably stainless steel, clamp, containing the removable power source. The power source and circuit board containing the LED light, and the electrical connection by a ball switch, which is on when the lid is in the upright position.

A photo cell can be located on top of the clamp to let the LED light illuminate when surrounding exterior light has been turned off or during evening or night-time conditions. On the top of the lid, the solar panel charges the battery when light is present on the solar panel. The LED light bulb can be positioned on the front side of clamp as to when on it lights the area in and around the toilet bowl.

When the toilet seat lid is lowered the ball switch, turns the power off to the light. The solar panel and glow are visible. The solar panel charges the battery and the glow is there to make it easy to find the toilet in the dark. The clamp is positioned on the toilet seat lid on the top leading edge and has photo cell to sense light located on the edge. On the inside of toilet seat lid clamp is the light housing containing the battery, circuit board, and ball switch. On the outside of the toilet seat lid clamp is the solar panel for recharging and glow for easy to find in dark situations.

The present new invention provides a solar powered device attached by a clamp which is placed on the top edge of the toilet seat Lid. The underside of device illuminates with a LED light the toilet bowl and seat in addition to the surrounding area of the bathroom, unlike the other inventions that only illuminate the toilet seat bowl. The present new invention will illuminate a glow from the toilet lid light clamp, when lifted it will self illuminate from the battery powered LED light and the absence of light will allow the light to turn on and gently illuminate the toilet area for men, women and children.

When lowered it will automatically switch off. In the lowered position when light is present it will recharge itself from the top of the clamp, on which mounted is a solar panel. The lid clamping method is to keep light from being exposed to unsanitary contaminations and would be universal for every toilet with a lid cover over the seat. By installing this device on to the toilet seat lid the solar light will recharge the battery. The light can be easily clamped on to the toilet lid, the light body is positioned visibly underside the seat lid. When the lid is lowered the other side of the clamp displays the glow and solar panel. The solar panel is to recharge the battery is located on the underside of the clamp.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

Figure 1:
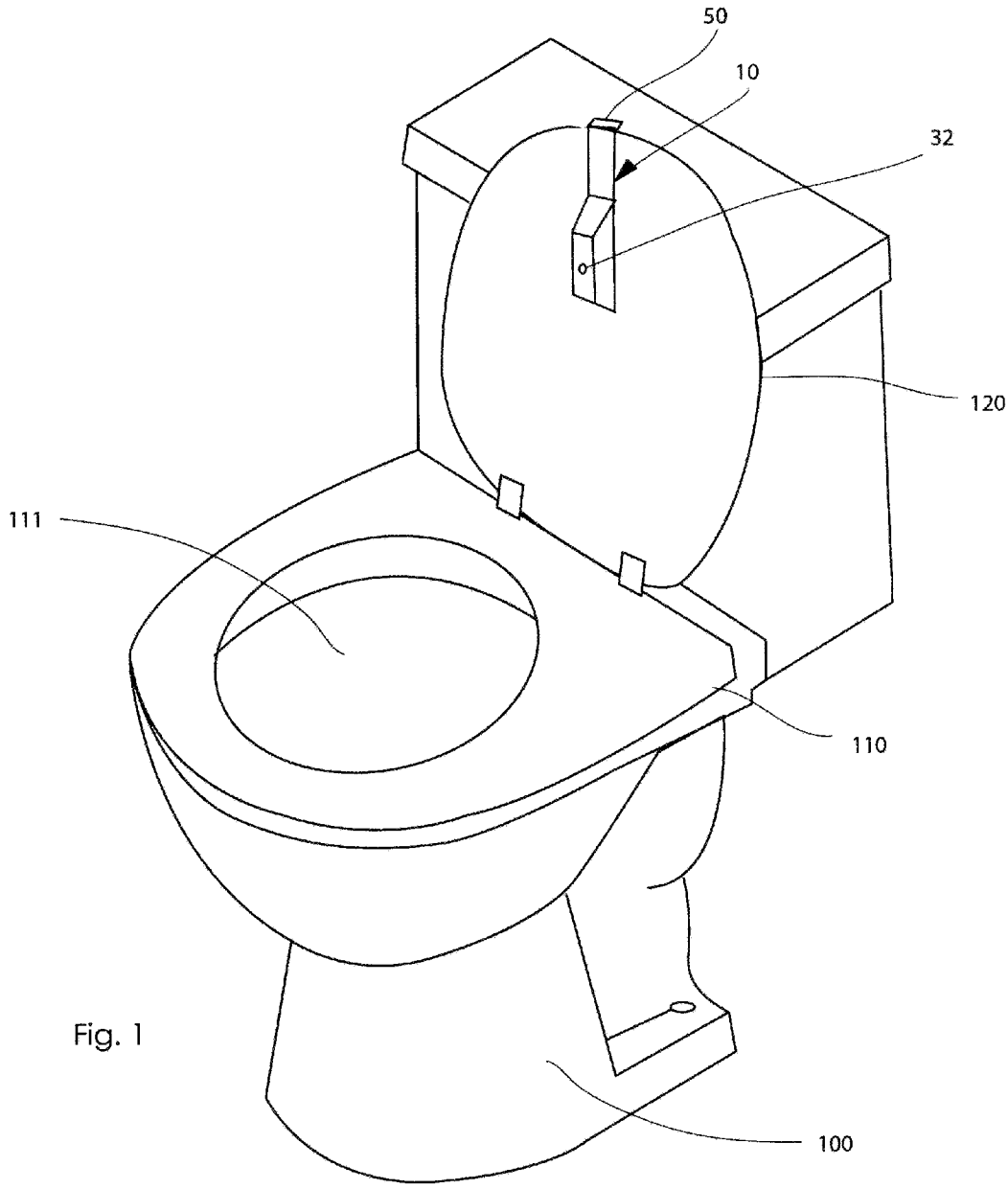
FIG. 1 is a perspective view of the toilet lid light device of the present invention clamped to a toilet seat lid on a toilet.

A listing of the components will now be described. Listed below is a guide in which the mechanical components match the device. Numbers are as following reference to FIG. 1-6;

10-Light Device
20-Battery (One Double AA)
30-Circuit Board
31-Condenser 50 volt 2.2
32-LED (white LED preferred)
33-Resistor 200 ohm
34-DIOAD
35-Solid State Relay
36-Photocell circuit side
37-Resistor 51K
38-Switched side of relay
39-Pos switched side of circuit board
40-Positive battery side of circuit board
41-negative side of circuit board
42-LED power side of circuit board
50-Stainless steel clamp
52-first leg
53-connecting midportion
54-second leg
60-Solar Panel
61-Metal Screws
62-Back panel to hold battery
63-Mounting hole
64-Solar panel DIOAD
70-Photocell for light switch
75-Connector Wire
80-plastic body mold housing
90-spring in side battery case to hold battery in place
95-mercury switch
96-contact point circuit board
100-Toilet/Toilet Bowl
110-Toilet Seat
111-Interior of toilet bowl
120-Toilet Seat Lid FIG. 1 is a perspective view of the toilet lid light device 10 of the present invention clamped to a toilet seat lid 120 that is hingedly attached to a toilet 100. The solar lid light device 10 is intended to be removably clamped to the top edge of toilet lid 120. When the toilet lid 120 is in an upright position, light is emitted from LED 32 in the direction of the interior 111 of the toilet bowl 100 and also around the exterior of the toilet 100 and on the toilet seat 110.

Figure 2:
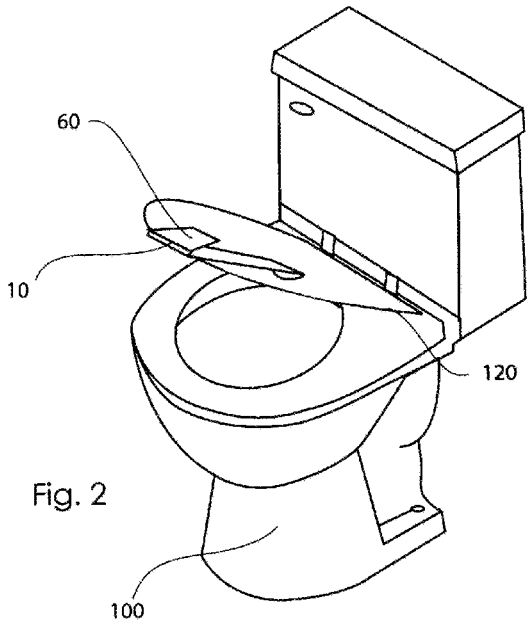
FIG. 2 is another perspective view of the toilet lid light device installed on the top and underside of the toilet lid, representing the placement of light illuminating the toilet bowl and the surrounding area around the bowl.

FIG. 2 is another perspective view of the toilet lid light device 10 installed on the top and underside of the toilet lid 120, representing the placement of light illuminating the toilet bowl 100 and the surrounding area around the bowl 100. The solar panel 60 is shown facing upward and outward and the components inside the device 10 are facing on the underside of toilet lid 120.

Figure 3:
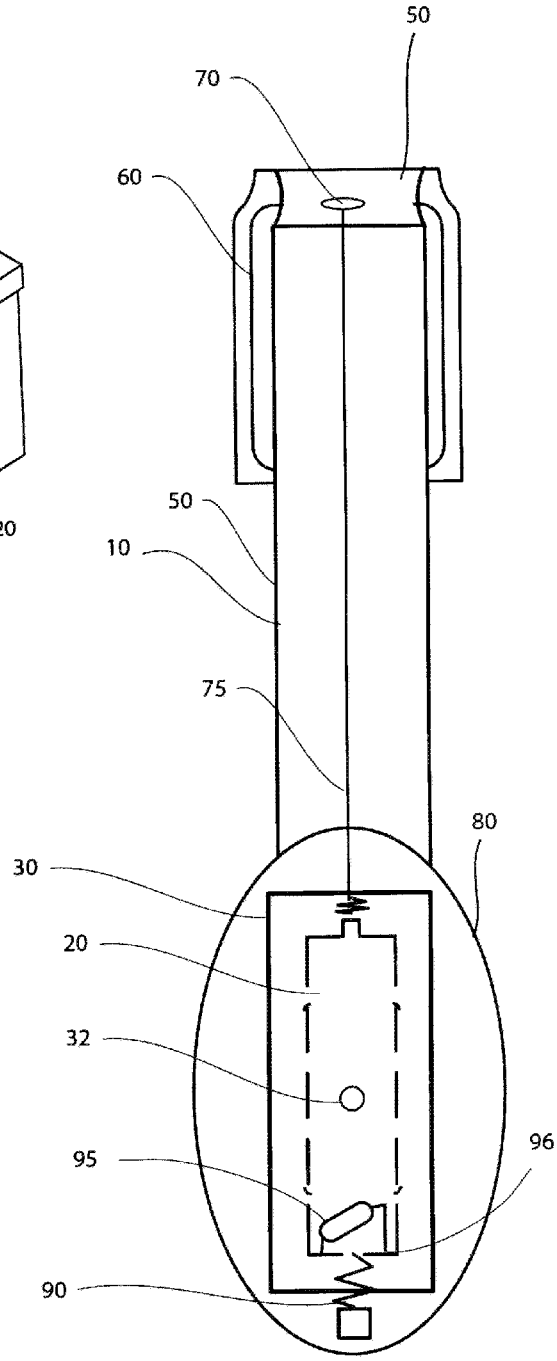
FIG. 3 is a front view of the toilet lid light device of the preceding figures with a partial cross-sectional view of the interior components.

FIG. 3 is a front view of the toilet lid light device of the preceding figures with a partial cross-sectional view of the interior components. Device 10 is shown with the clamp 50 on top, visible photo cell light 70, attached to a stainless steel device to house the circuit board 30 and its components, which include battery 20, LED 32 and Mercury switch 95 and contact 96 on the circuit board 30.

Figure 4:
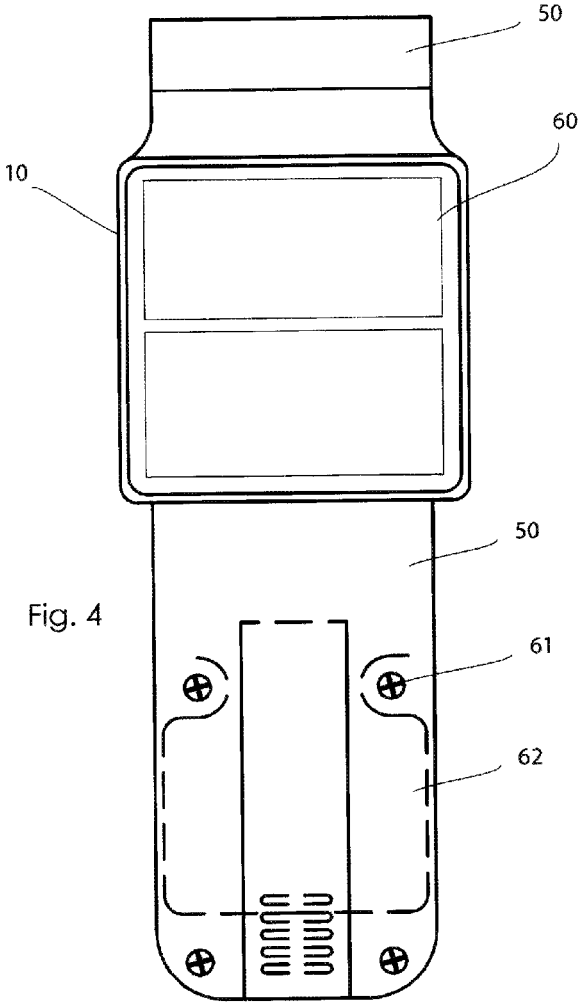
FIG. 4 is a back view of toilet lid device of FIG. 3 showing the solar panel, back panel, and screws to hold the panel in place.
Figure 5:
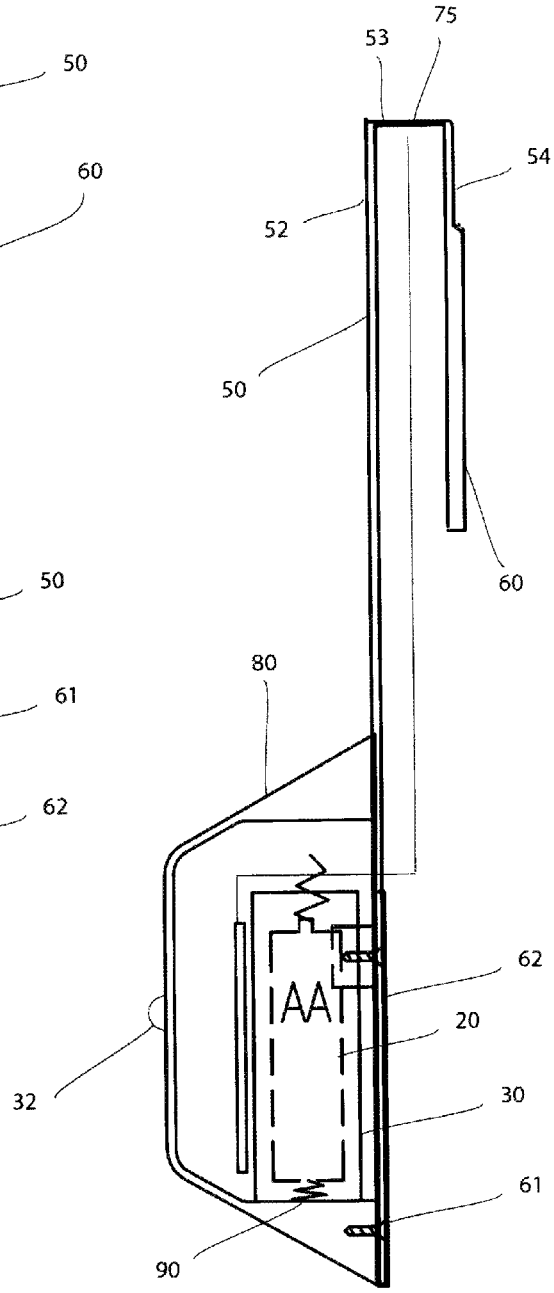
FIG. 5 is a side cross-sectional view of toilet lid device of FIG. 4 showing the interior components.

FIG. 4 is a back view of toilet lid device 10 of FIG. 3 showing the solar panel 60, battery closing back panel 62, and screws 61 to hold the panel 62 in place. FIG. 5 is a side cross-sectional view of toilet lid device of FIG. 4 showing the interior components.

Referring to FIG. 4 and FIG. 5, the device 10 removably attaches to the underside 120 of toilet seat lid by the clamp 50. Screws 61 are provided to remove the cover 62 of the housing in order to access the internal components of the circuit board as well the battery 20.

Referring to FIG. 5, the side view of device 10 showing the solar panel 60 attached to leg 54 of the stainless steel clamp 50 which is attached to the front side components such LED 32, battery 20, and the circuit board 30. Back side showing the screws 61 which secure the back panel 62 which secures the battery 20 in place. The stainless steel clamp 50 can also has the photocell and connector wire 75 attached.

Referring to FIG. 4 and FIG. 5, the lid light device 10 can be clamped on the top of toilet lid 120 by clamp 50 that can be a formed from a bent or U-shaped stainless steel having a first leg 52 and a second leg 54 with connecting midportion 53 therebetween. Each of the legs 52 and 54 can have a rectangular configuration and have a width of approximately 2 to approximately 5 inches and each leg can have a thickness of approximately ⅛ to approximately ¼ inch thick. The second leg 54 is substantially shorter in length than the first leg 52. For example, the second leg 54 can have a length of less than half the length of the first leg 52. For example, if the first leg 52 is approximately 7 inches long, the second leg can be approximately 2½ inches long. The second leg 54 can be parallel to the first leg 52 or have an outer end slightly inwardly bent. The clamp 50 can be malleable to clamp onto the edge of a toilet seat lid. Alternatively, the clamp 50 can be one piece molded from plastic and the like.

Referring to FIGS. 3 and 5, spring 90 is inside the cover 62 and is used to hold the battery 20 in place. A housing 80 such as a plastic body mold housing can enclose the components that include the battery 20.

Figure 6:
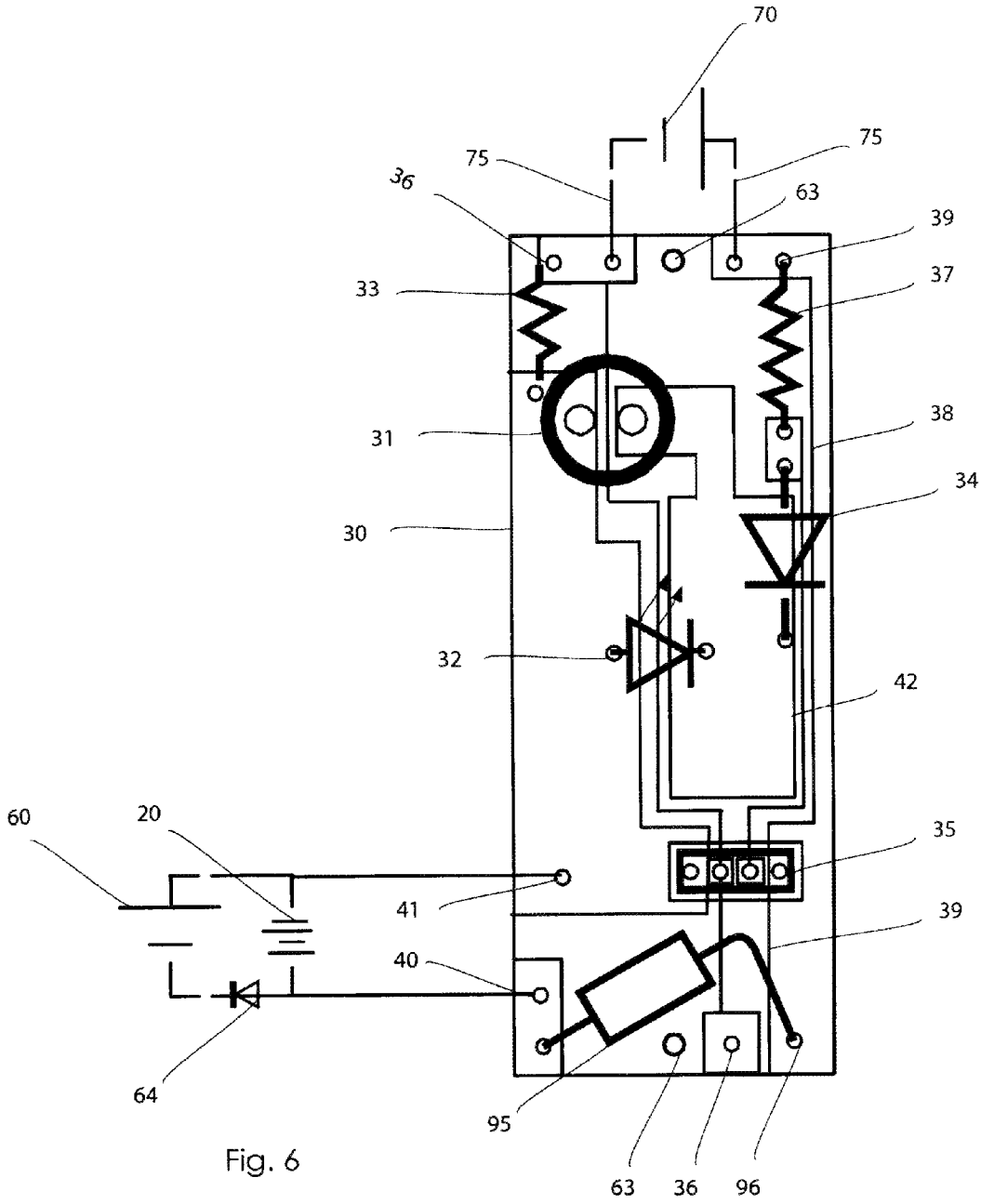
FIG. 6 is an electrical schematic of the toilet lid device with circuit board components.

FIG. 6 is an electrical schematic of the toilet lid device 10 with circuit board components. The battery 20 stores the power for the circuit board 30 (CB) the battery 20 is charged by the solar panel 60 which has a diode 64 to prevent power loss from solar panel 60. The battery 20 powers the circuit board 30 through the positive battery side 40 of the circuit board 30 and the negative side 41 of the circuit board 30. When power comes through the circuit board 30 it comes through positive side 40 on the circuit board 30 to the mercury switch 95. When the mercury switch 95 is in the upright position, the mercury switch 95 closes and lets power go to side 96 side of board 30 and sends power through the positive switched side 39 of the circuit board (CB) 39 to the solid state relay 35 and continues to the photo cell 70 that senses light in the area of the lid light device 10.

When the photo cell 70 does not sense light it sends power through photocell circuit side 36 with the help of resistor 33 to the solid state relay 35 and closes the solid state relay 35. (Resistor 37 helps energize the power side (positive side 42) of the LED 32). This sends power through the switched side 38 of the relay 35 to the diode 34 which prevents power from back feeding the solid state relay 35. And in conjunction with the condenser 31 the LED 32 will illuminate with the ground side 41 of the circuit board 30 to the negative side 41 of the circuit board 30, and back to the said battery 20. When exterior light is present, the solar panel 60 continuously charges the battery 20. Light can come from sunlight and/or incandescent light or fluorescent light sources.

Figure 7:
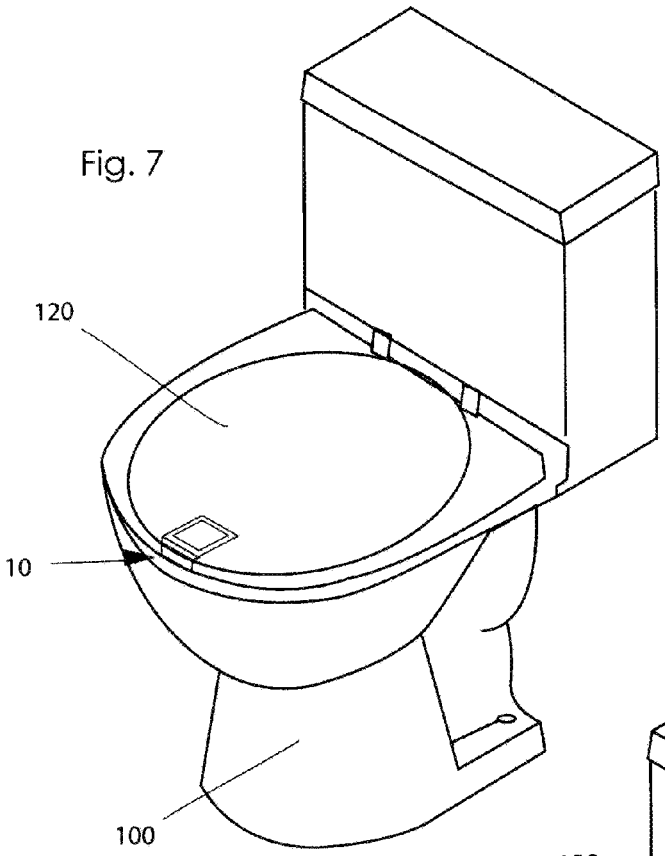
FIG. 7 is another perspective view of the lid attached toilet lid device with the lid in a down position.
Figure 8:
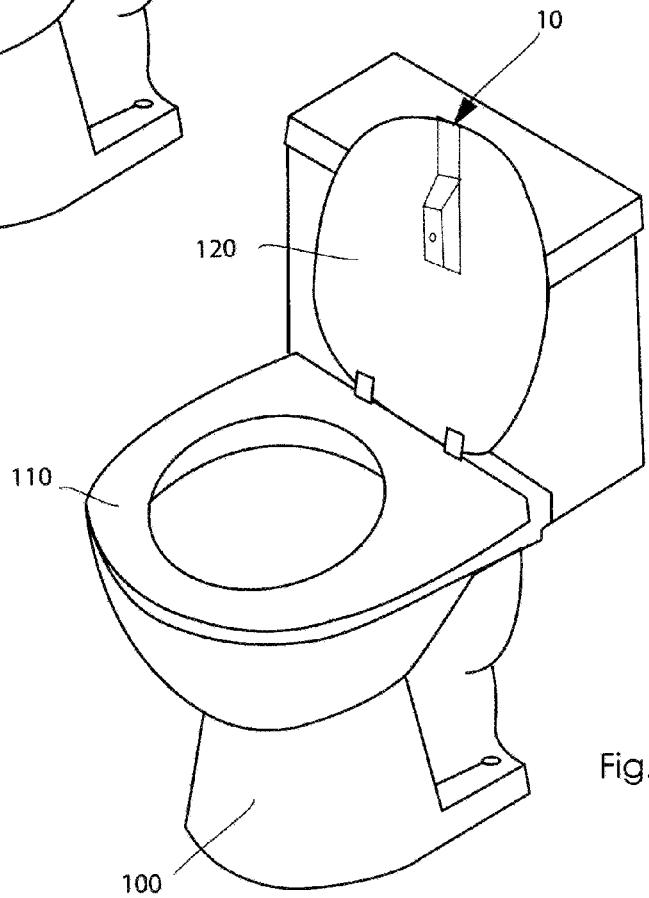
FIG. 8 is another perspective view of the lid attached toilet lid device with the lid in a fully raised position.

FIG. 7 is another perspective view of the lid attached toilet lid device 10 with the lid 120 in a down position. FIG. 8 is another perspective view of the lid attached toilet lid device 10 with the lid 120 in a fully raised position.

Referring to FIG. 7 and FIG. 8, when the toilet lid 120 is in the lowered position (horizontal), the mercury switch 95 is open and the LED 32 is powered off. Lifting the toilet lid 120 to the upper raised position (vertical), causes the mercury switch 95 to close allowing power 96 to activate the LED 32 to emit light. Lowering the lid turns the switch 95 to an open position turning the LED 32 off.

Although a mercury switch is described, the invention can work with other types of switches, such as a metal ball and contact switch and other types tilt switches, and the like.

While the device is described as having one white LED, the invention can use colored LEDS, and can have plural LEDs as needed. While the battery is listed as a double AA battery, the invention can be powered by other batteries such as but not limited to AAA batteries, nine volt batteries, and the like. While the preferred device is shown as an attachable device to toilet lids, the invention can be molded into a toilet lid as one piece with the lid, where the device cannot be separately removed.

Although the described embodiment is described as using stainless steel, the invention can be done in other materials, such as but not limited to molded plastic and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A light device for toilets, comprising:

a one piece U-shape clamp with a first leg, a second leg and a connecting portion therebetween, the first leg and the second leg each having a generally rectangular configuration, each of the legs having a width of approximately 2 to approximately 5 inches and a thickness of approximately ⅛ to approximately ¼ of an inch, the second leg being shorter in length than the first leg;

a light source attached to an outer surface of the first leg, aimed to an exterior side of the first leg;

a battery attached to the outer surface of the first leg adjacent to the light source for providing power to activate the light source;

a solar panel having a generally flat outer exposed surface and an inner surface attached to an outer surface of the second leg for charging the battery; and a tilt switch for activating the light source when the device is moved from a horizontal position to a vertical position, wherein the clamp is adaptable to clamp about an outer edge of a lid on a toilet.

2. The light device of claim 1, further comprising:

a photocell attached to the connecting portion of the clamp, the photocell for activating the light source when the tilt switch is activated.

3. The light device of claim 1, wherein the U shaped clamp is formed from one piece of stainless steel.

4. The light device of claim 1, wherein the U shaped clamp is formed from a single part of molded plastic.

5. The light device of claim 1, wherein the light source is an LED (light emitting diode).

6. The light device of claim 1, wherein the tilt switch is a mercury switch.

7. The light device of claim 1, further comprising:

a removable lid for allowing the battery to be replaced.

8. The light device of claim 1, further comprising:

a single housing on the outer surface of the first leg for housing the lighting source and the battery.

9. The light source of claim 1, further comprising:

an inwardly bent outer end on at least one of the first leg and the second leg.

10. A method of providing illumination into a toilet bowl, comprising the steps of:

providing a U shaped clamp with a top leg and a bottom leg, the top leg being shorter than the bottom leg;

providing a light source on the bottom leg;

providing a battery for supplying power to the light source, adjacent to the light source;

providing a solar cell with a generally flat outer surface on the top leg to charge the battery;

clamping the clamp about an outer edge of a lowered toilet seat lid so that the solar cell is facing upward, and the light source is facing downward; and activating the light source by moving the lowered toilet seat lid to a raised vertical position.

11. The method of claim 10, wherein the step of activating includes the step of:

providing a tilt switch for activating the light source.

12. The method of claim 11, wherein the tilt switch includes a mercury switch.

13. The method of claim 10, wherein the light source is an LED (light emitting diode).

14. The method of claim 10, wherein the U shaped clamp is a one piece of bent stainless steel.

15. The method of claim 10, wherein the U-shaped clamp is one piece of molded plastic.

16. The method of claim 10, further comprising the step of:

removing a panel to access and replace the battery.

17. The method of claim 10, further comprising the step of:

providing a single housing on the outer surface of the bottom leg for housing the lighting source and the battery.

18. The method of claim 10, further comprising the step of:

inwardly bending at least one outer end of the top leg and the bottom leg to enhance the clamping of the clamp to the outer edge of the lowered toilet seat lid.

19. The method of claim 10, wherein the step of providing the U shaped clamp includes the steps of:

providing both the top leg and the bottom leg with a generally rectangular configuration; and providing both the top leg and the bottom leg with a width of approximately 2 to approximately 5 inches and a thickness of approximately ⅛ to approximately ¼ of an inch.

* * * * *